United States Patent [19]

Meyers

[11] Patent Number: 4,754,790

[45] Date of Patent: Jul. 5, 1988

[54] CONVERTIBLE PURSE

[76] Inventor: Phyllis L. Meyers, 385 North San Rafael, Pasadena, Calif. 91105

[21] Appl. No.: 31,562

[22] Filed: Mar. 30, 1987

[51] Int. Cl.[4] ..... A45C 3/08

[52] U.S. Cl. ..... 150/104; 150/113; 190/903; 383/97

[58] Field of Search ..... 150/111, 112, 113, 103–106; 190/903; 383/97

[56] References Cited

U.S. PATENT DOCUMENTS

| | | | |
|---|---|---|---|
| 2,518,572 | 8/1950 | Sanders | 150/112 |
| 2,529,724 | 11/1950 | Conwiser | 150/113 |
| 2,620,005 | 12/1952 | Hall | 150/112 X |
| 3,414,033 | 12/1968 | Tucker | 150/113 |
| 3,543,825 | 12/1970 | Dobbs | 150/112 X |
| 3,971,458 | 7/1976 | Koenig | 190/903 X |
| 4,161,201 | 7/1979 | Carp | 150/113 X |

*Primary Examiner*—William Price

*Attorney, Agent, or Firm*—Fulwider, Patton, Rieber, Lee & Utecht

[57] ABSTRACT

A convertible purse includes an outer purse having a plurality of panels defining an interior cavity, an inner purse, sized to be received within the interior cavity, the inner purse having a plurality of panels defining various compartments therein, some of the compartments having zippers with distinguishing indicia on their pull tabs, and a fastener to releasably attached the inner purse to the outer purse and allowing the inner purse to be interchanged with other outer purses.

10 Claims, 2 Drawing Sheets

FIG. 4
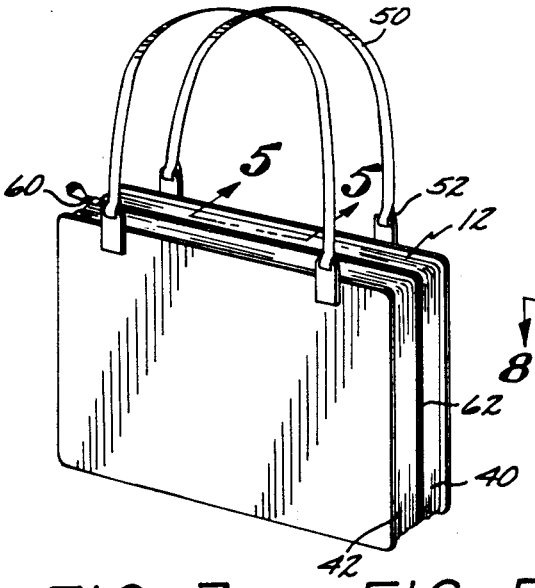
FIG. 6
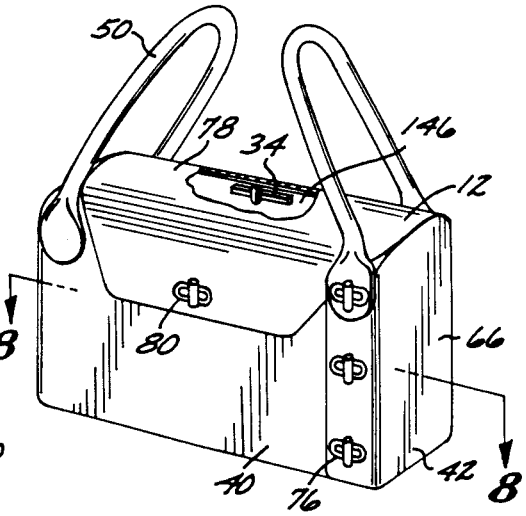
FIG. 7
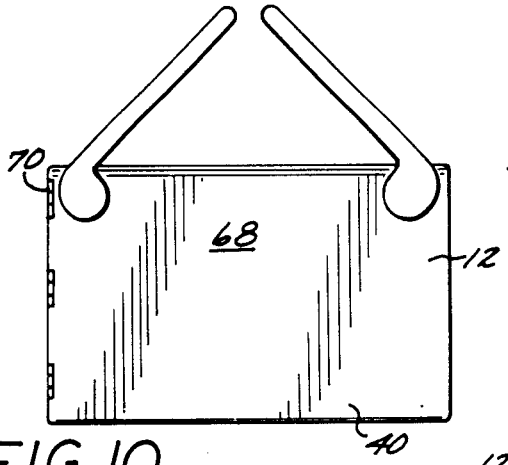
FIG. 5
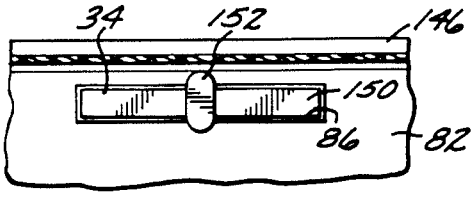
FIG. 8
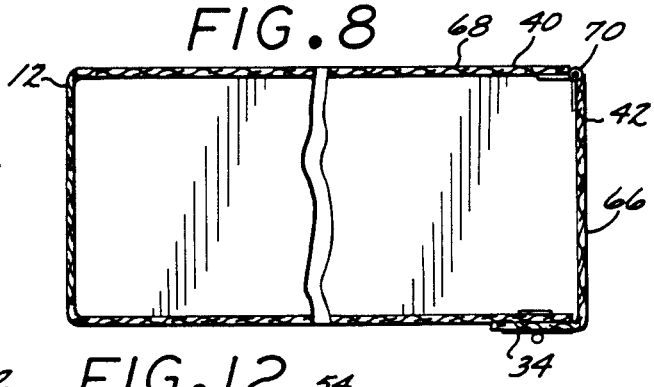
FIG. 10
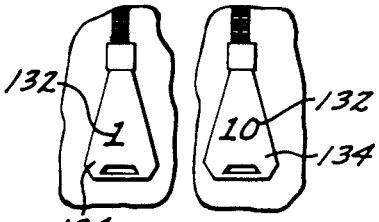
FIG. 12
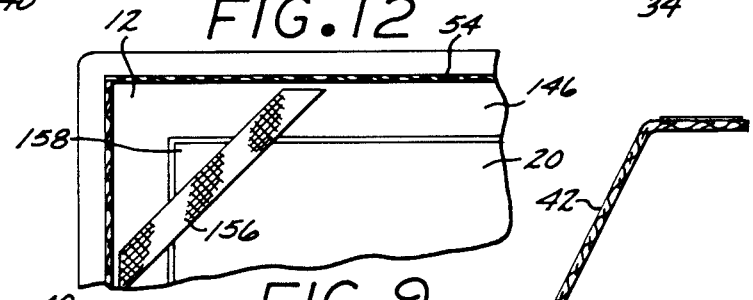
FIG. 11
FIG. 9
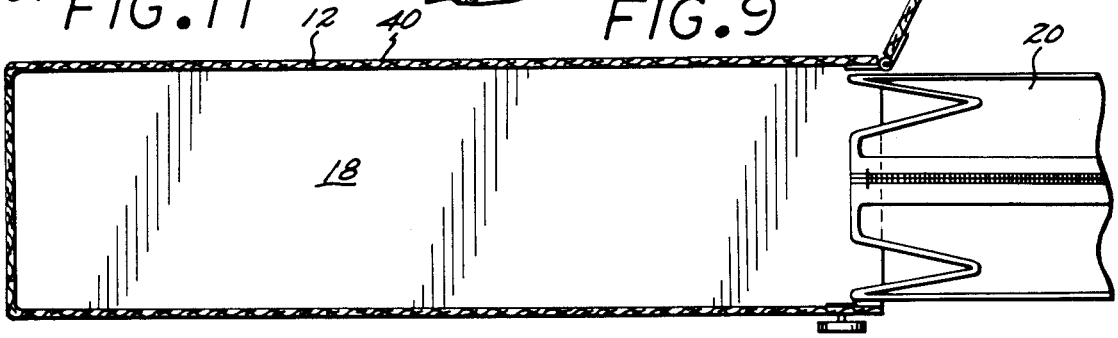

CONVERTIBLE PURSE

BACKGROUND OF INVENTION

This invention relates generally to improvements in purses and, more particularly, to a new and improved purse enabling the rapid transfer of its contents to differently designed or colored exterior purse.

Purses are containers which can be used to carry coins, toilet articles or other items used by persons throughout the day. Indeed, common experience indicates that there are a number of items vital to the daily needs of the purse owner. As these items accumulate over periods of time, a great number of articles may be contained within the purse. As a result, it is often times difficult to find a purse with a sufficient number of pockets to segregate or organize the number of transported items.

Because of the need to effectively segregate these items from one another, some of these pockets should be resealable. This prevents or minimizes the unpleasantry of an unintentionally opened article from distributing its contents throughout the entire interior of the purse. For example, it is highly desirable to have separate pockets for cosmetics or fountain pens. In addition, the sealable compartments retain the articles placed therein, to maintain the organization of the purse even when it is turned upside down. However, while there may be purses with a sufficient number of sealable pockets, enabling the segregation of items this, coupled with the high number of articles which may be contained within the purse, prevents the quick and orderly transfer of articles from one purse to another. As a result, if the owner lacks the time to make the transfer, he or she may be forced to use the same purse every day.

In addition, as a result of the need for resealable compartments to separate the different articles contained within the purse, these buttoned or zipped compartments hide their contents from the purse owner. This slows the owner's ability to quickly locate an item from amongst a number of zippered compartments since the person must open and close a number of these compartments in order to locate the specifically desired item.

Another consideration is the fact that purses form an integral part of the fashion statement issued by the clothing of the owner. Indeed, the shape and color of the individual purses and their coordination with the rest of the ensemble, forms an important element of such fashion statement. Thus, the wearer will usually attempt to coordinate the color and shape of the purse in conjunction with the color and design of the rest of the outfit. However, in light of the aforementioned inability to quickly and orderly transfer the contents of one purse to another purse, the user of the purse may be unable to switch purses. As a result, the user may be forced to use the same purse with clashing or conflicting outfit.

Hence, those concerned with fashion and the use of purses have long recognized the need for an improved purse which enables the quick and orderly transfer of those items contained within the purse to a purse exterior which is more intuned with the color and design of the rest of the clothing worn by the owner on that particular day. The present invention fulfills all of these needs.

SUMMARY OF THE INVENTION

In accordance with the present invention, a new and improved purse embodying a novel structure is provided for incorporating an adequate number of enclosed pockets to segregate articles, in addition to enabling easy and rapid transfer of the entire contents from one purse exterior to another, thus allowing the consumer to coordinate her color and design with the rest of the outfit selected.

Briefly and in general terms, by way of example, and not necessarily by way of limitation, the convertible purse of the present invention generally includes an inner purse sized to be received within an outer purse. Fastening means disposed on the inside surface of the outer purse releasably attaches the inner purse to the outer purse.

More particularly, the outer purse may be of any size, shape, and exterior color in order to adapt its use to any style or outfit worn by the consumer. The outer purse generally has at least two body portions or panels, releasably joined together to form an interior cavity. These portions have a connector therebetween to permit them to be separated for receiving the inner purse. A fastener releasably attaches the portions to one another. In one preferred form, a pair of longitudinal panels are joined to an end panel having a fold therein, enabling the separation of the two side panels. A zipper releasably attaches the longitudinal panels to one another, to selectively expose the interior. Alternatively, an end panel may be pivotally or hingedly connected to a side panel. A plurality of turn-lock assemblies may releasably attach the panels to one another.

The inner purse portion of the present invention is a combination of resealable and continually open pockets contained within an integral subunit. In one preferred form, the inner purse includes a bottom panel and a plurality of longitudinal or side panels extending upward from the bottom panel. A plurality of end panels extend upward from the bottom panel. The longitudinal, end and bottom panels are joined together to define a plurality of compartments or pockets therebetween. Additional longitudinal or central panels are provided to define additional compartments. These compartments may be zippered to selectively expose the interior of specific compartments. Further more, in order to facilitate the identification of the contents of such sealed compartments the purse of the present invention includes indicia or identifying symbols which are placed on the zipper assemblies to distinguish between the various pockets and to facilitate the identification of the pocket's content.

Furthermore, a fastener means is provided to releasably secure the inner purse to the outer purse. More specifically, in one preferred form the fastener has a turn-lock portion rotatably mounted on a back plate, the back plate being mounted to an inside surface of the outer purse, for insertion through an aperture formed in the outermost longitudinal walls of the inner purse. Upon insertion of the back plate and turn-lock portion through the aperture, the rotation of the turn-lock from the first position to a second position prevents the withdrawal of the inner purse through the aperture fastener and thus enables the releasable attaching of the inner purse to the outer purse. Alternatively, a strip of resilient material may be mounted on the inside surface of the outer purse to engage and restrain the inner purse.

As a result, the new and improved convertible purse of the present invention is easy to use and enables the quick conversion from a purse having an exterior of one particular design or color to another exterior design or color. The articles contained within the purse constructed in accordance with the present invention may be easily and quickly transferred from one exterior to another, facilitating coordination of the purse with the wearer's fashion. In addition, a purse constructed in accordance with the present invention enables easy identification of contents within the enclosed compartments.

These and other objects and advantages of the invention will become apparent from the following more detailed description, when taken in conjunction with the accompanying drawings of illustrative embodiments.

DESCRIPTION OF THE DRAWINGS

FIG. 4 is a perspective view of one embodiment of the outer purse of the present invention in an enclosed position;

FIG. 5 is an enlarged fragmented view of a fastener of the present invention in the second or retaining position taken along lines 5—5 as shown in FIG. 4;

FIG. 6 is a partially fragmented perspective view of an alternative embodiment of the outer purse of the present invention;

FIG. 7 is a rear plane view of the alternative embodiment of FIG. 6;

FIG. 8 is a fragmented sectional top view taken along lines 8—8 as shown in FIG. 6;

FIG. 9 is a top sectional view of the alternative embodiment in FIG. 6, further depicting the insertion of the inner purse within the opening formed by the separation of the first and second body portions;

FIG. 10 and FIG. 11 are enlarged fragmented views of the indicia placed on the zippers for distinguishing between compartments; and FIG. 12 is an alternative embodiment of the fastener of the present invention releasably attaching the inner purse to the outer purse.

DETAILED DESCRIPTION OF THE PREFERRED EMBODIMENT

Figure 1:
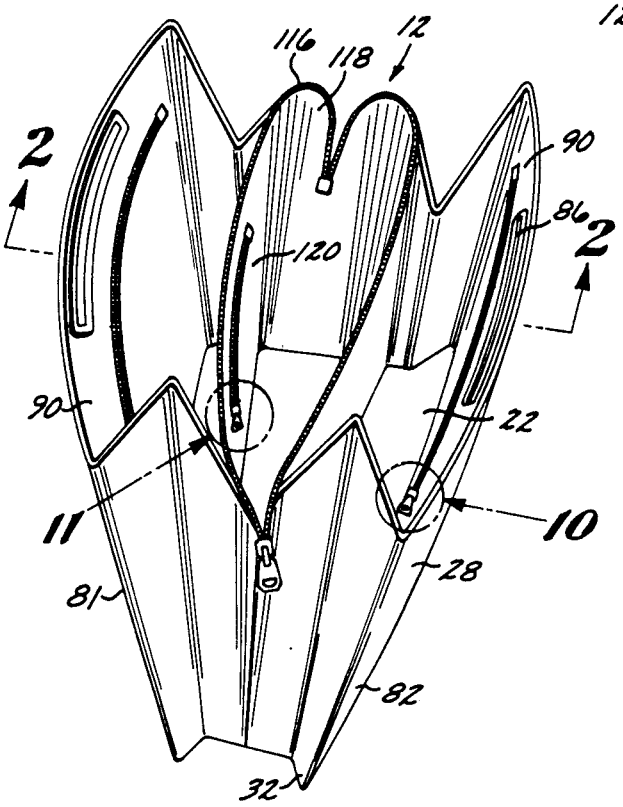
FIG. 1 is a top perspective view of an inner purse of the present invention.
Figure 2:
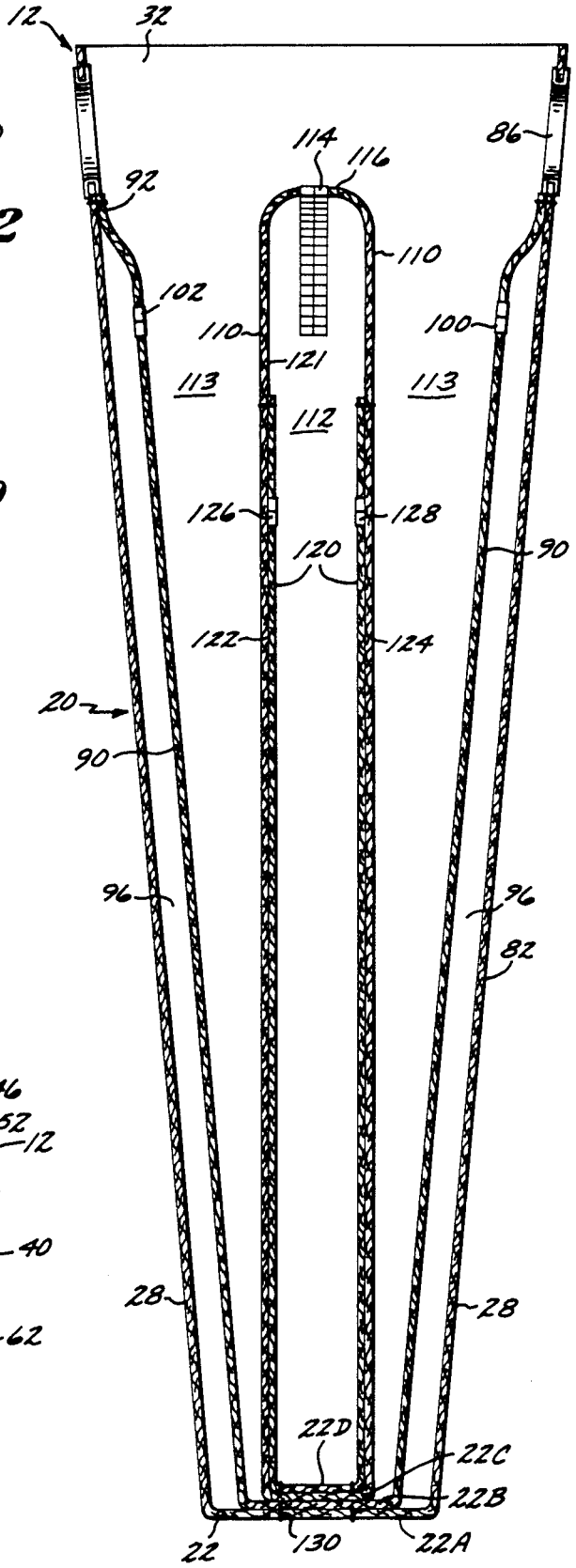
FIG. 2 is a vertical cross-sectional plane view of the inner purse incorporating the special features of the present invention taken along lines 2—2 as shown in FIG. 1.
Figure 3:
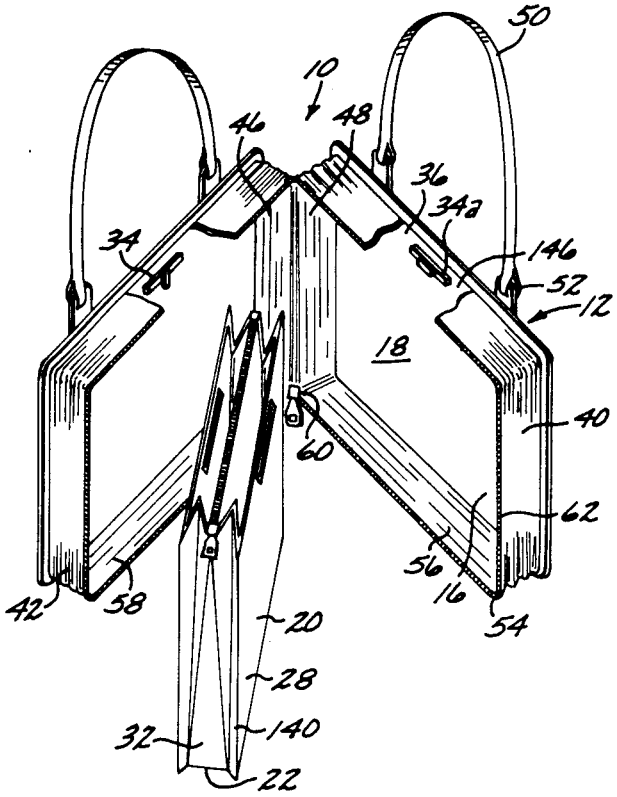
FIG. 3 is a partially fragmented view of the convertible purse of the present invention.

As shown in the exemplary drawings for purposes of illustration, a convertible purse, referred to generally by the reference numeral 10 in FIG. 3, is provided for enabling the quick and orderly transfer of the articles contained within one purse exterior to that of a different exterior. More specifically, referring to FIG. 3, the convertible purse of the present invention generally includes an outer purse 12 having a plurality of panels 16 joined together to define an interior cavity 18 therein. As best shown in FIGS. 3 and 9, an inner purse 20 is sized to fit in the interior cavity 18. Referring to FIGS. 2 and 3, the inner purse includes a bottom panel 22 and a plurality of longitudinal or side panels 28 extending upward from the bottom panel. A plurality of end panels 32 extend upward from the bottom panel, and extend between the side panels. As best shown in FIGS. 1 and 2 the side, end and bottom panels define a plurality of compartments therebetween. Referring to FIG. 3, a plurality of first fasteners 34 are mounted to the inside surface 36 of the outer purse to releasably attach the inner purse to the outer purse.

More particularly, as shown in FIGS. 3, 8 and 9, the outer purse 12 comprises a plurality of panels 16 releasably joined together to form an interior cavity 18. The outer purse portion comprises of a first body portion 40 and second body portion 42. In one preferred form, as best shown in FIG. 3, i.e. a "swagger" type hand bag, the two portions comprise a first and a second longitudinal or side body panels pivotally connected to one another by an end panel 46. A fold 48 along a vertical axis within the end panel permits the side panels to be separated to provide an opening between the portions to enable the receipt of the inner purse 20 therebetween. As with conventional swagger-type hand bags, double top handles 50 are connected to the outer purse by attachment tabs 52 to aid in the carrying of the convertible purse of the present invention.

Referring to FIG. 3, a first zipper assembly 54 fastens the body portions to releasably secure the first and second outer purse body portions to one another and to selectively expose the interior cavity 18. In one form, as best shown in FIG. 3, the corresponding zipper tape portions 56 and 58 are joined to the opposite facing portions of the two outer purse body portions so that the movement of the zipper slide 60 along the teeth 62, will enclose the purse assembly as best shown in FIG. 4. Leather tabs or other features (not shown) may be used to hide or disguise the zipper assembly from view. For example, an additional panel of leather (not shown) may be laid over the top of the zipper assembly to hide it from view.

Alternatively, referring to FIGS. 6 through 9, and as best shown in FIG. 8, the outer purse may be in the form of an end panel 66 pivotally mounted to a side or back panel 68 by a plurality of hinges 70. A plurality turn-lock assemblies 34, as more fully described later in this application, may be used to releasably attach the end panel to the body of the outer purse. Additionally, a top flap 78, may be connected to the first portion or back wall 68 to pivot about a longitudinal axis over the top of the purse to enable access to the inner purse disposed therein. A flap turn lock assembly 80, as more fully described later in this application, may be used to releasably attach the flap to the body of the outer purse. Conventional handles 50 facilitate the transport of the bag.

As shown in FIGS. 1 and 2, sized to be received within the outer purse 12, is an inner purse 20 including a bottom panel 22, a plurality of longitudinal or side panels 28 extending upward from said bottom panel, and a pair of end panels 32 extending upward from the bottom panel and joined to the side panels. The bottom, longitudinal and end panels together define a plurality of compartments therebetween.

More specifically a pair of outermost longitudinal panels 82 extend upwardly and outwardly relative to the bottom panel. The outermost longitudinal panels may be joined along an edge 84 to an end panel 32. For the purposes of illustration and not limitation, the panels may extend upwardly about eight and three-quarters inches, and outward about three inches. An aperture or eyelet 86 is formed adjacent the top of the outermost longitudinal panels to engage the fasteners 34 as described more fully later in this application. Disposed adjacent and laterally inward from each outermost side panel is an intermediate longitudinal panel 90. The intermediate longitudinal panel is joined adjacent the bottom of outermost longitudinal panel to the bottom panel 22 and along an opposite edge 92 to the outermost longitudinal side panels 82, to define side compartments 96, as best shown in FIG. 2. In the preferred form, the edge 92 may be sealed along its entire top length to close off the side compartments. In such embodiment, second and third zippers 100 and 102, analogous to first zipper 54, are disposed within the intermediate longitudinal panels to enable selective exposure of the compartments 96 and to communicate the interior of the enclosed side compartment to the outside.

A pair of central longitudinal panels 110 extend upward from the bottom panel 22 and, together with the bottom panel 22, define a central compartment 112 and a pair of intermediate or lateral side compartments 113 defined between the central and the outermost longitudinal panels 82. In the preferred form, a fourth zipper 114 may be disposed along the apices or top edge 116 of the central longitudinal panels to enable the selective enclosure of the central compartments. As best shown in FIG. 1, the top edges 118 may extend downwardly and inwardly relative the apices in an arcuate manner, such that the central longitudinal panels will remain apart relative to each other when the zipper is closed, as best shown in FIG. 2. In addition, this construction tends to pull the central longitudinal panels, broadening the compartments 113.

A pair of second central longitudinal panels 120 may be formed adjacent each first central longitudinal panels 110 and joined to the bottom panel 22 and to the interior surface of the central longitudinal panel 121 to define a second and third central compartments or pockets 122 and 124. Fourth and fifth zippers 126 and 128 may be disposed in the panels as more fully described elsewhere in this application, to selectively expose and communicate the interior of the second and third central compartments with the outside. For ease of construction, while this specfication refers to a "bottom panel 22", as best shown in FIG. 2, a bottom panel may be a plurality of bottom panels *22a–2d*, such that the corresponding longitudinal panels may be single pieces of material in a U-shaped cross-sectional configuration joined by bottom connectors 130. These connectors include, for example, thread, staples, or glue.

Because the number of zippered compartments within the inner purse 20 which selectively expose the interior of each respective compartment, as best shown in FIGS. 10 and 11, the convertible purse of the present invention may have indicia or symbols 132 on the zipper pull tab 134 to identify or distinguish between the different compartments or pockets so defined, by the various inner purse panels. While the numerals "1" and "10" are shown, for purposes of illustration, other identification means may be used, e.g. different numbers, letters, color codes or other distinguishing items.

As discussed earlier, the end panels 32 of the inner purse 20 may be joined to the longitudinal side panels in order to define the above described pockets. Furthermore, as best shown in FIG. 1, the end panels may include inserts 140 to create an accordian gusset to facilitate and strengthen the flexing ability and movement of the longitudinal side panels 28 outward relative the bottom panel 22.

Referring to FIGS. 3 and 5, a plurality of fasteners 34 are mounted on the inside surface 146 of the outer purse to releasably attach the inner purse 20 to the outer purse 12. As best shown in FIG. 5, in one preferred form, a back plate 150 is mounted to the inside surface and positioned to cooperate and pass through the apertures 86 formed in the outermost longitudinal panels 82 as earlier described. Rotatably mounted to the back plate is a turn lock portion 152. This turn lock portion, is insertable through the aperture 86, when in the first position, as best shown in FIG. 3 by turn lock 34*a*. Rotation of the turn lock portion 152 to the second position, as best shown in FIG. 5, illustrates that rotation of the turn lock will prevent that portion from moving back through the aperture and thus releasably attach the outermost longitudinal panels 82 of the inner purse 20, to be interposed between the inner surface 146 of the outer purse and the turn lock.

Alternatively, as best shown in FIG. 12, the inner purse 20 may be releasably secured within the outer purse 12 by a strip 156 of resilient material diagonally mounted to the inside surface 146. The strip may be positioned to engage a corner 158 of the inner purse 20 and thus retain the inner purse 20 interposed between the inside surface 146 of the outer purse and strip.

In operation, the consumer takes the purse assembly as shown in FIGS. 4 or 6 and separates the outer purse body portions 40 and 42 from each other to enable the withdrawal of the inner purse 20 from the interior cavity 18. The inner purse is removed and the articles to be carried are inserted into the earlier described closed or open compartments, e.g. 96, 112 or 113. The filled inner purse is then inserted into the outer purse, as shown, for example, in FIG. 9. The inner purse is then reattached through the use of the fastener 34 or the strip 156 as shown in FIGS. 5 and 12 respectively, to the selected outer purse 12. The outer purse is then reclosed as shown in FIGS. 4 or 6 and the zipper or turn-lock assemblies are engaged to seal the particular exterior used.

By the use of the convertible purse of the present invention, the exterior design, color, or shape of the purse may be quickly and easily changed to correspond to whatever color or fashion desired by the consumer. Furthermore, because the inner purse is a wholly separate and integral element, the emptying of each individual pocket and transfer of the articles contained therein to a second purse's interior need not be performed. Indeed, since the zipper or enclosed portions are identified by the appropriate symbols or indicia, the items will be in the same pockets and thus will be quickly and easily located for use.

It will be apparent from the foregoing that, while particular forms of the invention have been illustrated and described, various modifications can be made without departing from the spirit and scope of the invention. Accordingly, it is not intended that the invention be limited, accept by the appended claims. For example, the fastening means as described in the present invention may also include other fastening means including but not limited to snaps, hook and eye assemblies, and hook and loop tape assemblies (such as the velcro-type hook and loop tape system). In addition, while the bags as illustrated are North-South bags, i.e. have a long and narrow shape, the present construction is easily adaptable to East-West construction, i.e. hand bags which are wider than they are long. Furthermore, the use of the basic construction without handles, as in a clutch-type bag is also contemplated by the inventor.

I claim:

1. A combination of an outer purse and an inner purse comprising:

an outer purse having first and second body portions, each including a pair of upstanding side body panels, a bottom panel and a pair of end panels, one of said end panels being formed with a hinge along a vertical axis permitting the side panels to be separated horizontally to define a cavity between the first and second body portions which removably receives said inner purse;

securement means interposed between the first and second body portions to selectively expose said cavity;

said inner purse being sized to be removably received within the cavity of the outer purse, with said inner purse including a bottom panel, a plurality of longitudinal side panels extending upward from the bottom panel and a pair of end panels joined along their edges to said longitudinal side panels and extending upward from the bottom panel, said bottom, longitudinal side panels and end panels defining a plurality of open-topped compartments therebetween for storing articles;

means selectively closing the tops of the compartments of said inner purse to retain said articles therein; and fastener means on the side panels of the outer purse selectively engageable with the longitudinal side panels of the inner purse to releasably secure the inner purse within the cavity of the outer purse as said articles are deposited within or removed from the compartments, the outer purse being selectively interchanged with a second outer purse without disturbing the articles in said inner purse.

2. A purse construction as set forth in claim 1 wherein the fastener means on the side panels of said outer purse and the longitudinal side panels of said inner purse include an eyelet engageable with a turn lock.

3. A purse construction as set forth in claim 1 wherein the fastener means on the side panels of said outer purse is a resilient strip engageable with a longitudinal side panel of said inner purse.

4. A purse construction as set forth in claim 1 wherein the securement means of said outer purse is a continuous zipper.

5. A purse construction as set forth in claim 1 wherein the securement means of said outer purse includes a plurality of eyelets and turn locks.

6. A purse construction as set forth in claim 1 wherein zippers are provided to selectively close the tops of the compartments of said inner purse, such zippers having indicias corresponding to the contents of the individual compartments.

7. A purse construction as set forth in claim 2 wherein the means selectively closing the tops of said compartments include zipper means having indicia corresponding to the contents of the individual compartments.

8. A purse construction as set forth in claim 3 wherein the means selectively closing the tops of said compartments include zipper means having indicia corresponding to the contents of the individual compartments.

9. A purse construction as set forth in claim 4 wherein the means selectively closing the tops of said compartments include zipper means having indicia corresponding to the contents of the individual compartments.

10. A purse construction as set forth in claim 5 wherein the means selectively closing the tops of said compartments include zipper means having indicia corresponding to the contents of the individual compartments.

* * * * *